US008176755B2

(12) United States Patent
Lim et al.

(10) Patent No.: US 8,176,755 B2
(45) Date of Patent: May 15, 2012

(54) HEATING PART AND LAUNDRY TREATING MACHINE HAVING THE SAME

(75) Inventors: Jae Yoen Lim, Gyeongsangnam-do (KR); Jong Chul Bang, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 407 days.

(21) Appl. No.: 12/432,420

(22) Filed: Apr. 29, 2009

(65) Prior Publication Data

US 2010/0058815 A1 Mar. 11, 2010

(30) Foreign Application Priority Data

Apr. 30, 2008 (KR) ..... 10-2008-0040611

(51) Int. Cl.
*D06F 25/00* (2006.01)

(52) U.S. Cl. ..... 68/3 R; 68/20

(58) Field of Classification Search ..... 68/3 R, 68/19.1, 20

See application file for complete search history.

(56) References Cited

U.S. PATENT DOCUMENTS

| | | | | | |
|---|---|---|---|---|---|
| 2,165,487 | A * | 7/1939 | Johnson | 68/18 C |
| 2,566,488 | A * | 9/1951 | Gould | 68/20 |
| 2,816,429 | A * | 12/1957 | Kurlancheek | 68/19.2 |
| 2,936,527 | A * | 5/1960 | Hutt | 34/549 |
| 3,402,477 | A * | 9/1968 | Hubbard | 34/543 |
| 3,402,576 | A * | 9/1968 | Krupsky | 68/4 |
| 3,555,701 | A * | 1/1971 | Hubbard | 34/602 |
| 6,671,978 | B1 * | 1/2004 | McGowan et al. | 34/596 |
| 6,978,556 | B1 * | 12/2005 | Cornelious | 34/596 |
| 7,617,702 | B2 * | 11/2009 | Sunshine et al. | 68/3 R |
| 7,913,419 | B2 * | 3/2011 | Tomasi et al. | 34/595 |
| 2008/0053166 | A1 | 3/2008 | Lim | |

FOREIGN PATENT DOCUMENTS

| | | | |
|---|---|---|---|
| CN | 1611659 | A | 5/2005 |
| CN | 201050016 | Y | 4/2008 |
| GB | 2 230 330 | * | 10/1990 |
| JP | 54-108060 | * | 8/1979 |
| JP | 04-187194 | * | 7/1992 |
| JP | 3625820 | * | 12/2004 |
| JP | 2006-021028 | * | 1/2006 |

* cited by examiner

*Primary Examiner* — Frankie L Stinson

(74) *Attorney, Agent, or Firm* — Birch, Stewart, Kolasch & Birch, LLP

(57) ABSTRACT

A laundry treating machine having a heating part is disclosed. A laundry treating machine includes a cabinet, a single partition wall partitioning inner space of the cabinet into a first space and a second space, and a hot air supply unit provided in the first space, the hot air supply unit supplying hot air to the second space and comprising a heating part. The heating part includes a heater heating air, a case supporting the heater to form an air path and preventing heat of the heater from transmitting in a different direction from the air path, a sensing part sensing the temperature of the heater, and a control part controlling the heater according to a temperature value measured by the sensing part.

11 Claims, 3 Drawing Sheets

HEATING PART AND LAUNDRY TREATING MACHINE HAVING THE SAME

CROSS REFERENCE TO RELATED APPLICATION

This application claims the benefit of the Korean Patent Application No. 10-2008-0040611, filed on Apr. 30, 2008, which is hereby incorporated by reference as if fully set forth herein.

BACKGROUND OF THE DISCLOSURE

1. Field of the Disclosure

The present invention relates to a heating part and laundry treating machine having the heating part.

2. Discussion of the Related Art

Generally, laundry treating machines are home appliances that are used to clean laundry by washing and drying laundry, using detergent and mechanical friction. Washing machines are categorized into washing machines, dryers and single appliances performing both washing and drying functions. Such conventional laundry machines have various disadvantages.

SUMMARY OF THE DISCLOSURE

Accordingly, the present invention is directed to a laundry treating machine.

An advantage the present invention is to provide a laundry treating machine to enhance washing efficiency and an overall exterior appearance.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating machine includes a cabinet; a single partition wall partitioning inner space of the cabinet into a first space and a second space; and an hot air supply unit provided in the first space, the hot air supply unit supplying hot air to the second space and comprising a heating part, wherein the heating part comprises a heater heating air; a case supporting the heater to form an air path and preventing heat of the heater from transmitting in a different direction from the air path; a sensing part sensing the temperature of the heater; and a control part controlling the heater according to a temperature value measured by the sensing part.

The case may be formed of heat-insulating or heat-resistant material.

The case may include an upper case and a lower case corresponding to the upper case, the upper case and the lower case engagingly coupled to each other.

The case may include an upper case and a lower case, preventing the heat of the heater from transmitting upward or downward in a different direction of the air path.

The heating part may include a first heater provided in the upper case, a second heater provided in the lower case and a partition structure provided in the first heater and the second heater.

The first heater and the second heater may be driven selectively or simultaneously.

The laundry treating machine may further include an off unit turning off the heating part if the heating part is overheated beyond a predetermined temperature.

The off unit may be provided in an open portion formed in the case to be adjacent to the heater.

The laundry treating machine may further include a closing member preventing the heat of the heater from transmitting outside the case in a different direction of the air path via the open portion.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
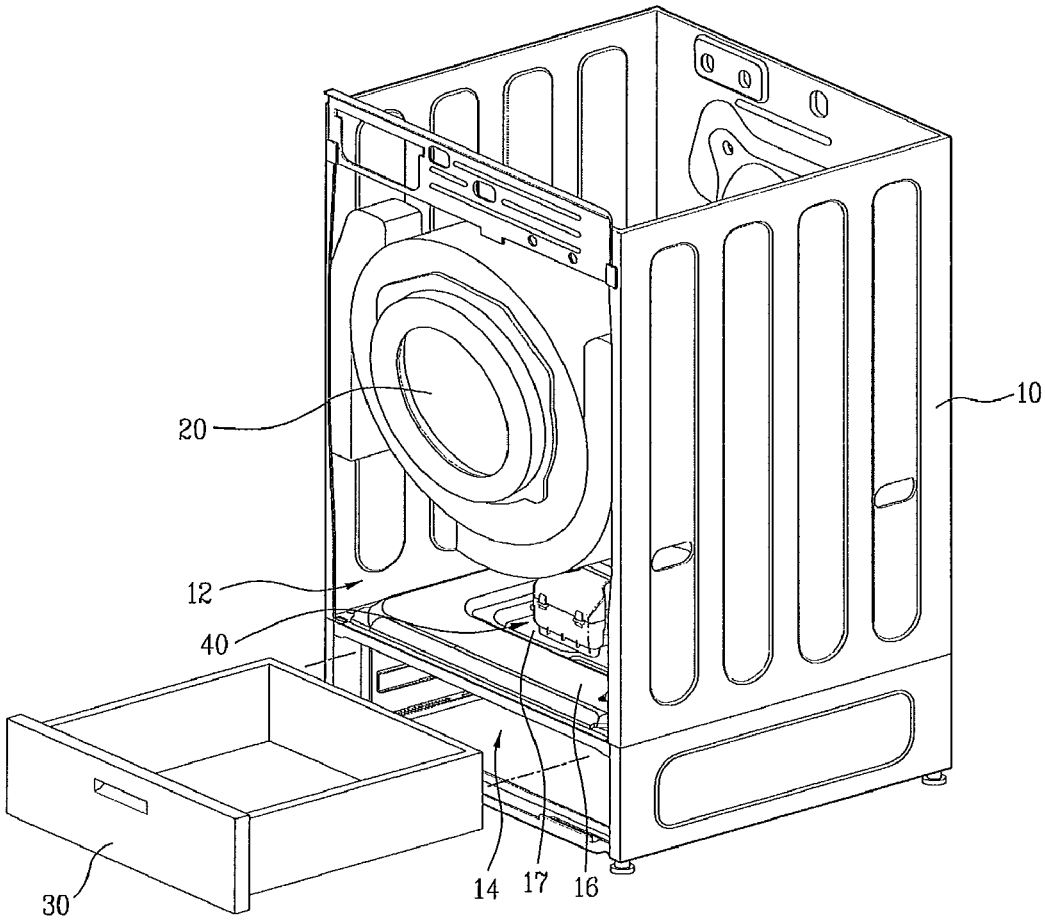
FIG. 1 is a perspective view illustrating a laundry treating machine according to an exemplary embodiment of the present invention.

In reference to FIG. 1, a laundry treating machine includes a cabinet 10, a drum 20, a drawer 30 and a hot air supply unit 40. The cabinet 10 defines an exterior appearance of the laundry treating machine and the drum 20 is rotatable within a first space 12 of the cabinet 10. The drawer 30 is detachably provided in a second space 14 of the cabinet 10 and the hot air supply unit 40 supplies hot air to the drawer 30 and the second space 14.

The cabinet 10 defining the exterior appearance of the laundry treating machine may accommodate various components which will be described later. The cabinet 10 includes the first space 12 where the rotatable drum 20 is provided and the second space 14 where the detachable drawer 30 is provided.

Washing or drying operation for the laundry may be performed in the first space 12 where the drum 20 is provided. Auxiliary treating operation for the washed and dried laundry may be performed in the second space 14 where the detachable drawer 30 is provided. In other words, conventional washing or drying operation is performed in the first space 12 and additional drying or a refreshing operation is performed in the second space 14. Here, the term 'refreshing' may mean a process of removing wrinkles in the laundry by supplying air, hot air or steam to the laundry.

The cabinet 10 could be formed of two separate members to include the first space 12 and second space 14. According to this embodiment, the cabinet 10 may be formed of a single material. That is, this embodiment presents that the first space 12 and the second space 14 are formed within the cabinet 10 formed of a single material. If the first space 12 and the second space 14 are formed in the cabinet formed of the single member, the assembly work of the cabinet 10 will be simple and the necessary time will be reduced accordingly.

According to the washing machine of this embodiment, the cabinet 10 formed of a single material includes the first space 12 and the second space 14 and it further includes a partition wall 16 which partitions inner space of the cabinet into the first space 12 and the second space 14. The partition wall 16 could partition the inner space horizontally into an upper space corresponding to the first space 12 and a lower space corresponding to the second space 14. However, the present invention is not limited to the above.

That is, according to this embodiment, the cabinet 10 includes the partition wall 16 which is employed as a base of the first space and as a top cover of the first space 12 simultaneously, such that the first space 12 and the second space 14 may form pressure containers. As the single partition wall 16 is employed as the base of the first space 12 and the top cover of the second space 14, the assembly work will be remarkably simple and the time necessary for the assembly work will be reduced, compared with a case of including a separate base of the first space 12 and a separate top cover of the second space 13.

The first space 12 is formed in an upper portion and the second space 14 is formed in a lower portion with respect to the partition wall 16. In this case, the hot air supply unit 40 may be provided on the partition wall 16. Within the first space 12 is provided the rotatably oriented drum 20 and within the second space 14 is provided the detachable drawer 30. The volume of the first space 12 may be substantially larger than that of the second space 14. As a result, to utilize the inner space efficiently, it is preferable that the hot air supply unit 40 is provided in the first space 12, rather than in the second space 14.

Specifically, the hot air supply unit 40 may be detachably provided on the partition wall 16. Here, a recess portion 17 may be provided on the partition wall 16 to accommodate the hot air supply unit 40.

In the first space 12 above the partition wall 16 is positioned the drum 20 and water may fall on the partition wall 16 because of the rotation of the drum during a washing, rinsing or drying-spinning cycle. As a result, the recess portion 17 may also collect the water falling above the partition wall 16. In addition to that, the recess portion 17 accommodates the hot air supply unit 40. As a result, although not shown in the drawings, a water drainage structure may be provided at a predetermined portion of the recess portion 17 to drain the collected water without contacting the hot air supply unit 40. Alternatively, a bottom surface of the recess portion 17 may slope enough for the collected water not to flow toward the hot air supply unit 40.

In the meanwhile, the drawer 30 is detachably provided within the cabinet 10, specifically, in a lower portion of the front of the cabinet 10. The drawer 30 may be sliding open forward or sliding closed to be movable into the cabinet 10. Such the drawer 30 may be formed with an open top to form an accommodating space capable of receiving the laundry.

Although not shown in the drawings, the laundry treating machine may further include a deodorization filter (not shown) or a fragrance addition unit (not shown). The deodorization filter removes the unpleasant smell of the laundry and the fragrance addition unit supplies fragrance material to the laundry such that the user may feel pleasant in case of wearing the laundry.

As follows, the hot air supply unit 40 supplying hot air toward the inside of the drawer 30 will be described in detail.

Figure 2:
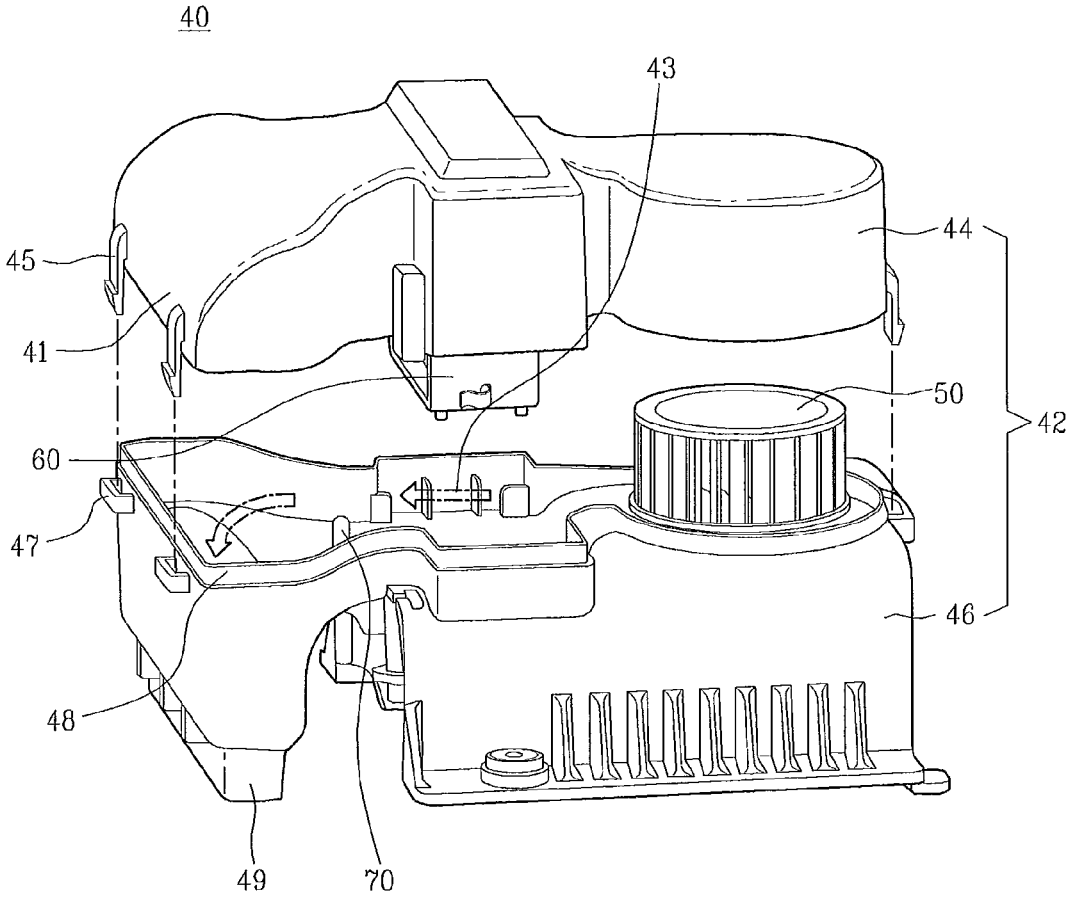
FIG. 2 is a perspective view illustrating a hot air supply unit shown in FIG. 1.

In reference to FIG. 2, the hot air supply unit 40 may include a housing 42, a fan 50, a heating part 60 and a sub control part (not shown). The housing 42 is detachably connected to a top surface of the partition wall (16, see FIG. 1) and it forms an air path. The fan 60 blows the air along the path and the heating part 60 heats the air guided along the path by the fan 50. The sub-control part (not shown) controls the fan 50 and the heating part 60.

First of all, the housing 42 forms the path which the air flows along and the fan 50, the heating part 60 and the sub-control part are provided in the housing 42. Here, the housing 42 would be formed as one body of a single member and it is preferable that the housing 42 includes an upper housing 44 and a lower housing 46. The lower housing 46 is detachably coupled to the top surface of the partition wall and the upper housing 44 is detachably coupled to the lower housing 46. The detachable upper and lower housings 44 and 46 make it simple and convenient to repair inner components of the hot air supply unit 40 for maintenance.

Specifically, the lower housing 46 is detachably coupled to the top surface of the partition wall 16 by a coupling member such as a hook, bolt or the like.

The upper housing 44 is detachably coupled to a top of the lower housing 46 by a coupling member such as a hook, bolt or the like. Here, the shape of the upper housing is approximately corresponding to that of the lower housing. According to this embodiment, at least one hook 45 may be provided in the upper housing 44 and at least one engaging member 47 corresponding to the at least on hook 45 may be provided at the lower housing 46. The upper housing 44 may be coupled to the lower housing 46 efficiently and it may be connected, forming a path 43 through which air flows along an arrow shown in FIG. 4.

Such the hot air supply unit 40 may be positioned the top surface of the partition wall 16, that is, below the drum (20, see FIG. 1). When the drum 20 is operated, water may fall on the hot air supply unit 40. If the water comes into the housing 42, the inner components of the housing 42 such as the heating part 60 would malfunction or damage and there might be a danger of a fire. Especially, if the upper housing 44 and the lower housing 46 of the housing 42 are formed of separate members, respectively, the water may pass through the connection portion between them. Because of that, the hot air supply unit 40 according to this embodiment may include a prevention means for preventing the water from penetrating through the connection portion between the upper housing 44 and the lower housing 46.

Specifically, the water penetration preventing part includes a first extending portion 41 which extends downward from an edge of the upper housing 44 and a second extending portion 48 which extends upward from an edge of the lower housing 46.

The first extending portion 41 is formed along a rim of the upper housing 44, covering a predetermined portion of a rim of the lower housing 46. The second extending portion 48 is coupled to the first extending portion 41, specifically, to an inside of the first extending portion 41.

As a result, the water on the top of the housing 42 flows along a surface of the first extending portion 41 sequentially, not passing into the housing 42 along the connection portion, and it falls toward the partition wall 16.

As mentioned above, the path 43 is formed between the lower housing 46 and the upper housing 44 and air flows along the path 43 referenced to as an arrow in the FIG. 6 and inside the housing 42 may be provided the fan for blowing air along the path 43 and the heating part 60 for heating the air. Although it is shown in FIG. 6 that the fan 50 and the heating part 60 are arranged sequentially along the flowing direction of the air, the present invention is not limited thereto and it is also possible to arrange the heating part 60 and the fan sequentially.

Once the fan 50 is put into operation, air outside the housing 42 is drawn into the housing 42 and the air is heated by the heating part 60 such that the hot air may pass through an outlet 49. In this case, the outlet 49 is connected with a hot air inlet (15, see FIG. 2) formed in the partition wall 16, through which hot air passes. The hot air having passing through the outlet 49 may pass through the hot air inlet into the second space 14, that is, the drawer 30. Here, it is preferable that the rotation number of the fan 50 is adjustable. As the rotation number of the fan 50 is adjustable, the amount of the air supplied by the fan 50 may be adjustable.

In the meanwhile, the hot air supply unit 40 according to this embodiment may further include a first temperature sensor 70 which senses the temperature of the heated air. The heating part 60 may be controlled according to the temperature values monitored by the first sensor 70 to supply the heated air.

This first sensor 70 may be provided in a predetermined portion inside the path 43 and it is preferable that the first temperature sensor 70 is provided at an end of the path 43, that is, adjacent to the outlet 49. the sub-control part provided in the hot air supply unit 40 controls the operation of the heating part 60 according to the temperature values measured by the first temperature sensor and then it controls the temperature of the hot air supplied to the second space 14.

When the heating part 60 is controlled by the sensing the temperature of the hot air heated by the heating part 60, a single control part may be provided or two or more control part may be provided.

If at least two control parts including a main-control part and a sub-control part, a main-control part controls an overall operation of the laundry treating machine, specifically, the drum 20 and the hot air supply unit 40. The temperatures measured by the first temperature sensor 70 may be transmitted to the main-control part.

In addition to controlling the operation of the drum 20, the main-control part controls the operations of the heating part 60 and the fan 50 composing the hot air supply unit 40 according to a corresponding signal transmitted by the temperature sensor In this case, a command signal generated by the main-control part is transmitted to the sub-control part provided in the hot air supply unit 40. Hence, the sub-control part controls the operations of the heating part 60 and the fan 50 according to the command signal of the main-control part. If receiving the command signal from the main-control part, the sub-control part may perform only the on and off control of the heating part 60 or the fan 50 in order to simplify the configuration.

The heating part 60 positioned along the air path heats the air to produce heated air. This would damage to the housing 42. As a result, it is preferable that the heating part 60 heats only the air, not transmitting the heat to the housing 42.

Figure 3:
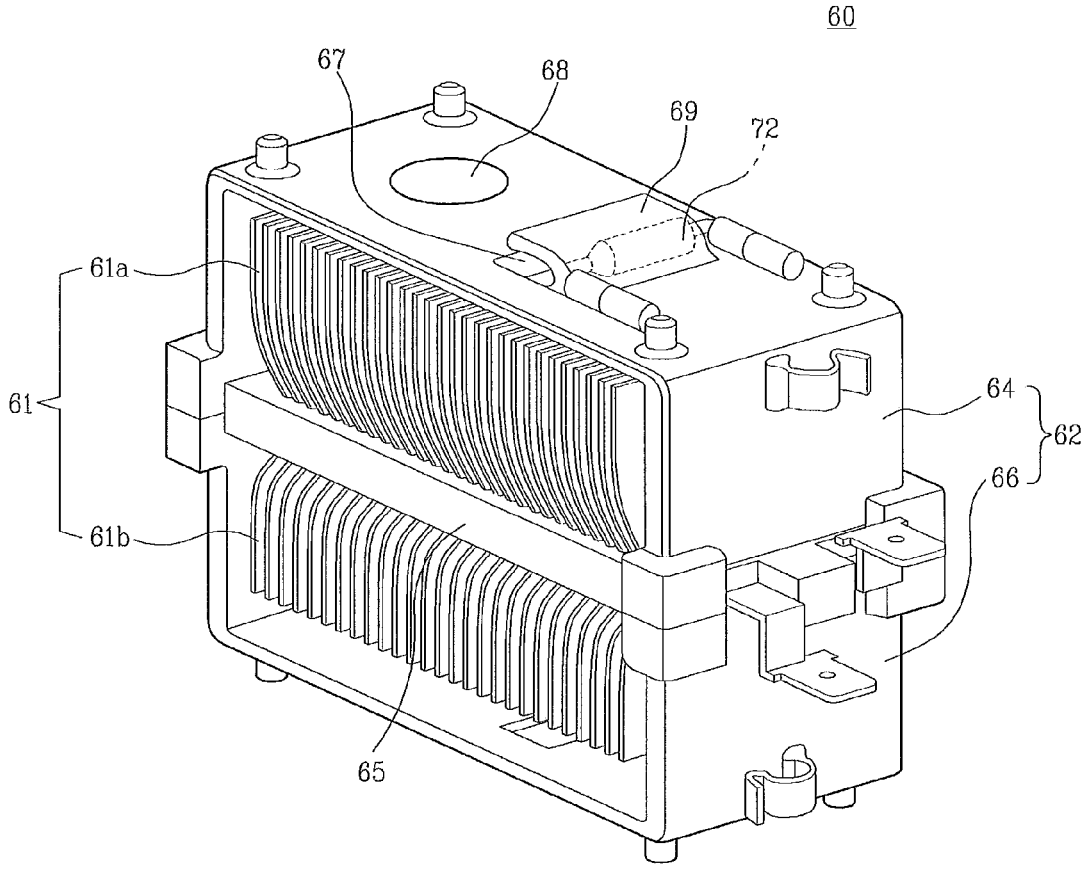
FIG. 3 is a perspective view illustrating a heating part shown in FIG. 2.

In reference to FIG. 3, the heating part 60 provided in the hot air supply unit according to this embodiment may include a heater for heating the blown air and a case 62 for accommodating the heater. The case 62 forms a path through which air flows and it supports the heater to prevent the heat produced by the heater from transferring to the housing (42, see FIG. 5).

Here, various heaters may be used within the hot air supply unit including a PTC heater (Positive Temperature Coefficient Heater). A PTC heater is desirable because it is easy to control.

A single heater may be provided. However, it is preferable that the heater may be horizontally divided into a first heater 61*a* and a second heater 61*b* along the path. The first and second heaters 61*a* and 61*b* are accommodated in the upper case 64 and the lower case 66, respectively. A partition structure 65 may be provided between the first and second heaters 61*a* and 61*b* to prevent the overheating of the heaters.

Either or both of the heaters 61*a* and 61*b* may be operated selectively and simultaneously such that the air may be heated appropriately according to the amount of the air in order to save energy. Specifically, if the air amount is relatively small, either of the first and second heaters 61*a* and 61*b* is operated to heat the air. If the air amount is relatively large, both of the first and second heaters 61*a* and 61*b* are operated simultaneously to heat the air.

The case 62 prevents the heater 61 from directly contacting with the inside of the housing 42, supporting the heater 61 to form the air path. As shown in FIG. 7, the case 62 may support the heater 61 not to interfere with the flow of the air along the heater 61. Because of that, the case may be fabricated with heat-resistant material having low heat conductivity or heat insulating material.

Here, the case 62 would be formed integrally of a single member and it is preferable that the case 62 is formed of separate members which will be assembled. Specifically, the case 62 includes an upper case 64 and a lower case 66 which are coupled to each other correspondingly. When the user repairing the heating part 60, the case 62 configured of the separate members makes it possible the disassembling and re-assembling after the repairing work.

As the heater 61 according to this embodiment is closely adjacent to the housing 42 of the hot air supply unit 40, the case may prevent the heat of the heater 61 from being transmitted to the housing 62 along a vertical direction, not simply preventing the heater 61 from contacting with the inside of the housing 42. That is, although the heat of the heater 61 could be transmitted to the air flowing along the path, the heat will not be transmitted toward the housing 42 positioned opposite to the air path.

Specifically, as shown in FIG. 3, the upper case 64 covers the upper heater 61*a* and the lower case 66 covers the lower heater 61*b*. The air passes the case 62 via the open portions of the upper case and the lower case 64 and 66, for example, from a left to right direction. then, the heater may not directly contact with the housing 42 by the case 62 and the heat generated by the heater 61 may be prevented from flowing into the housing positioned in the case 62 by the upper and lower cases 64 and 66.

If the heating part 60 for heating air is operated without the supplied air, the temperature of the heater 61 happens to increase too much and there will be possibilities of heater damage or fires. Because of that, an overheat prevention means may be provided in this embodiment.

Specifically, the heating part 60 according to this embodiment may further include a second temperature sensor 68 which senses the temperature of the heater 61. In addition to the first temperature sensor (70, see FIG. 6) for sensing the temperature of the heated air, the second sensor 68 senses the temperature of the heater 61. The second temperature sensor 68 is positioned adjacent to the heater 61 to monitor the temperature of the heater 61. The measured temperature values may be transmitted to the control part including the main-control part and the sub-control part. If the transmitted temperature is over a predetermined value, the control part, specifically, the main-control part determines that the heater 61 is overheated and it controls the heater 61 to be turned off. In case the sub-control part is provided, the sub-control part receives a corresponding command from the main-control part and turns off the heater 61.

In addition to the above temperature sensor, an off unit 72 for turning off the heater 61 may be provided as the overheating prevention means. As shown in FIG. 3, a thermal fuse 72 may be provided in the case 62.

Specifically, an open portion 67 is provided in the upper case 64 and the thermal fuse 72 is positioned in the open portion 67. The heat of the heater 61 is transmitted to the thermal fuse 72 via the open portion 67 such that the heat may be sensed more efficiently.

If such the open portion 67 is formed, the heat of the heater 61 flows out of the case 62 via the open portion 67 until to the housing 42 directly. As a result, the heating part 61 according to this embodiment a closing member 69 for closing the open portion 67 to prevent the heat of the heater from directly flowing to the housing 42. The closing member 69 may be formed a separate member and it is preferable as shown in FIG. 3 that the closing member 69 may be formed integrally with the upper case 64. Here, the closing member is configured to cover the open portion, having a bent portion, such that the heat may not flow toward the housing 42 via the open portion 67.

The thermal fuse 72 is connected with the heater 61. if the temperature of the heater 61 increases beyond the predetermined temperature, the thermal fuse 72 is cut to cut off the electricity supplied to the heater 61 and to prevent the overheat of the heater 61.

In reference to the drawings, an operation of the laundry treating machine having the above configuration will be described as follows.

The user introduces the laundry into the drum 20 and selects a wished course.

Hence, the user introduces the laundry in the drawer 30 of the cabinet 10 and selects an auxiliary course including a hot air cycle for supplying hot air or an air ventilation cycle for only ventilating air.

If the hot air cycle is put into operation, the hot air supply unit 40 heats air and it supplies hot air toward the second space 14, that is, the drawer 30. Here, the first temperature sensor 70 monitors the temperature of the hot air and it controls the hot air supply unit. The second temperature sensor 68 or the off unit 72 prevents the overheating of the heater 61.

In addition, while the heater 61 is operating, the case 62 prevents the heat of the heater 61 from transmitting toward the housing 42.

The laundry treating machine according to the present invention has a following advantage.

As mentioned above, the laundry treating machine including the heating part according to the present invention can doubly prevent the overheating of the heating part by using the temperature sensor and the off unit. Accordingly, it is possible to operate the laundry treating machine more securely.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treating machine comprising:
- a cabinet;
- a first space where washing and drying are performed;
- a second space where drying is performed;
- a single partition wall partitioning inner space of the cabinet into the first space and the second space; and
- a hot air supply unit provided in the first space, the hot air supply unit supplying hot air to the second space independent of the drying of the first space and comprising:
  - a housing for forming an air path from the first space to the second space;
  - a fan blowing air along the air path; and
  - a heating part heating the air guided along the air path by the fan, wherein the heating part comprises:
- a heater;
- a case supporting the heater to form the air path;
- a sensing part sensing the temperature of the heater; and
- a control part controlling the heater according to a temperature value measured by the sensing part.

2. The laundry treating machine of claim 1, wherein the case is configured to prevent heat of the heater from transmitting in a different direction from the air path and is formed of heat-insulating or heat-resistant material.

3. The laundry treating machine of claim 2, wherein the case comprises an upper case and a lower case preventing the heat of the heater from transmitting in an upward or downward direction different from a direction of the air path.

4. The laundry treating machine of claim 1, wherein the case comprises an upper case and a lower case corresponding to the upper case, the upper case and the lower case engagingly coupled to each other.

5. The laundry treating machine of claim 1, wherein the case comprises an upper case and a lower case.

6. The laundry treating machine of claim 5, wherein the heating part comprises a first heater provided in the upper case, a second heater provided in the lower case and a partition structure provided in the first heater and the second heater.

7. The laundry treating machine of claim 6, wherein the first heater and the second heater are driven selectively or simultaneously.

8. The laundry treating machine of claim 6, wherein the upper case covers the upper heater and the lower case covers the lower heater.

9. The laundry treating machine of claim 1, further comprising an off unit turning off the heating part if the heating part is overheated beyond a predetermined temperature.

10. The laundry treating machine of claim 9, wherein the off unit is provided in an open portion formed in the case to be adjacent to the heater.

11. The laundry treating machine of claim 10, further comprising a closing member preventing the heat of the heater from transmitting outside the case in a different direction from a direction of the air path via the open portion.

* * * * *